US007131891B2

(12) United States Patent
Elledge

(10) Patent No.: US 7,131,891 B2
(45) Date of Patent: Nov. 7, 2006

(54) SYSTEMS AND METHODS FOR MECHANICAL AND/OR CHEMICAL-MECHANICAL POLISHING OF MICROFEATURE WORKPIECES

(75) Inventor: Jason B. Elledge, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 41 days.

(21) Appl. No.: 10/425,252

(22) Filed: Apr. 28, 2003

(65) Prior Publication Data

US 2004/0214509 A1 Oct. 28, 2004

(51) Int. Cl.
*B24B 49/00* (2006.01)
*B24B 51/00* (2006.01)

(52) U.S. Cl. ..... 451/11; 451/1; 451/21

(58) Field of Classification Search ..... None
See application file for complete search history.

(56) References Cited

U.S. PATENT DOCUMENTS 4,498,345 A 2/1985 Dyer et al.
4,501,258 A 2/1985 Dyer et al.
4,502,459 A 3/1985 Dyer
4,894,579 A 1/1990 Higuchi et al.
4,971,021 A 11/1990 Kubotera et al.
5,036,015 A 7/1991 Sandhu et al.
5,069,002 A 12/1991 Sandhu et al.
5,081,796 A 1/1992 Schultz
5,163,334 A 11/1992 Li et al.
5,222,329 A 6/1993 Yu
5,232,875 A 8/1993 Tuttle et al.
5,234,867 A 8/1993 Schultz et al.
5,240,552 A 8/1993 Yu et al.
5,244,534 A 9/1993 Yu et al.
5,245,790 A 9/1993 Jerbic
5,245,796 A 9/1993 Miller et al.
RE34,425 E 11/1993 Schultz
5,314,843 A 5/1994 Yu et al.
5,413,941 A 5/1995 Koos et al.
5,421,769 A 6/1995 Schultz et al.

(Continued)

FOREIGN PATENT DOCUMENTS

WO WO 2004/067228 A1 8/2004

OTHER PUBLICATIONS

Applied Matrerials, "Mirra Mesa Advanced Integrated CMP," 2 pages □□<http://www.appliedmaterials.com/products/mirra_mesa.html>.*

(Continued)

*Primary Examiner*—Joseph J. Hail, III
*Assistant Examiner*—Bryan R. Muller
(74) *Attorney, Agent, or Firm*—Perkins Coie LLP

(57) ABSTRACT

Systems and methods for polishing microfeature workpieces. In one embodiment, a method includes determining a status of a characteristic of a microfeature workpiece and moving a carrier head and/or a polishing pad relative to the other to rub the microfeature workpiece against the polishing pad after determining the status of the characteristic of the microfeature workpiece. The carrier head also carries a plurality of piezoelectric members. The method further includes applying pressure against a back side of the microfeature workpiece in response to the determined status of the characteristic by energizing at least one of the plurality of piezoelectric members. In another embodiment, a system includes a workpiece carrier assembly, a plurality of piezoelectric members, a polishing pad, a metrology tool for determining a status of the characteristic, and a controller. The controller can have a computer-readable medium containing instructions to perform the above-mentioned method.

25 Claims, 3 Drawing Sheets

U.S. PATENT DOCUMENTS

| | | | | |
|---|---|---|---|---|
| 5,433,649 | A | 7/1995 | Nishida | |
| 5,433,651 | A | 7/1995 | Lustig et al. | |
| 5,439,551 | A | 8/1995 | Meikle et al. | |
| 5,449,314 | A | 9/1995 | Meikle et al. | |
| 5,486,129 | A | 1/1996 | Sandhu et al. | |
| 5,514,245 | A | 5/1996 | Doan et al. | |
| 5,533,924 | A | 7/1996 | Stroupe et al. | |
| 5,540,810 | A | 7/1996 | Sandhu et al. | |
| 5,573,442 | A | 11/1996 | Morita et al. | |
| 5,609,718 | A | 3/1997 | Meikle | |
| 5,618,381 | A | 4/1997 | Doan et al. | |
| 5,618,447 | A | 4/1997 | Sandhu | |
| 5,632,666 | A | 5/1997 | Peratello et al. | |
| 5,643,048 | A | 7/1997 | Iyer | |
| 5,643,060 | A | 7/1997 | Sandhu et al. | |
| 5,658,183 | A | 8/1997 | Sandhu et al. | |
| 5,658,190 | A | 8/1997 | Wright et al. | |
| 5,663,797 | A | 9/1997 | Sandhu | |
| 5,664,988 | A | 9/1997 | Stroupe et al. | |
| 5,668,061 | A | 9/1997 | Herko et al. | |
| 5,679,065 | A | 10/1997 | Henderson | |
| 5,681,204 | A | 10/1997 | Kawaguchi et al. | |
| 5,681,423 | A | 10/1997 | Sandhu et al. | |
| 5,700,180 | A | 12/1997 | Sandhu et al. | |
| 5,702,292 | A | 12/1997 | Brunelli et al. | |
| 5,720,845 | A | 2/1998 | Liu | |
| 5,730,642 | A | 3/1998 | Sandhu et al. | |
| 5,738,562 | A | 4/1998 | Doan et al. | |
| 5,747,386 | A | 5/1998 | Moore | |
| 5,777,739 | A | 7/1998 | Sandhu et al. | |
| 5,792,709 | A | 8/1998 | Robinson et al. | |
| 5,795,495 | A | 8/1998 | Meikle | |
| 5,798,302 | A | 8/1998 | Hudson et al. | |
| 5,807,165 | A | 9/1998 | Uzoh et al. | |
| 5,830,806 | A | 11/1998 | Hudson et al. | |
| 5,842,909 | A * | 12/1998 | Sandhu et al. | 451/7 |
| 5,851,135 | A | 12/1998 | Sandhu et al. | |
| 5,855,804 | A | 1/1999 | Walker | |
| 5,868,896 | A | 2/1999 | Robinson et al. | |
| 5,882,248 | A | 3/1999 | Wright et al. | |
| 5,893,754 | A | 4/1999 | Robinson et al. | |
| 5,895,550 | A | 4/1999 | Andeas | |
| 5,910,846 | A | 6/1999 | Sandhu | |
| 5,934,973 | A | 8/1999 | Boucher et al. | |
| 5,934,980 | A | 8/1999 | Koos et al. | |
| 5,936,733 | A | 8/1999 | Sandhu et al. | |
| 5,945,347 | A | 8/1999 | Wright | |
| 5,954,912 | A | 9/1999 | Moore | |
| 5,967,030 | A | 10/1999 | Blalock | |
| 5,972,792 | A | 10/1999 | Hudson | |
| 5,975,990 | A * | 11/1999 | Malcok | 451/41 |
| 5,980,363 | A | 11/1999 | Meikle et al. | |
| 5,981,396 | A | 11/1999 | Robinson et al. | |
| 5,994,224 | A | 11/1999 | Sandhu et al. | |
| 5,997,384 | A | 12/1999 | Blalock | |
| 6,006,739 | A | 12/1999 | Akram et al. | |
| 6,007,408 | A | 12/1999 | Sandhu | |
| 6,039,633 | A | 3/2000 | Chopra | |
| 6,040,245 | A | 3/2000 | Sandhu et al. | |
| 6,046,111 | A | 4/2000 | Robinson | |
| 6,054,015 | A | 4/2000 | Brunelli et al. | |
| 6,057,602 | A | 5/2000 | Hudson et al. | |
| 6,066,030 | A | 5/2000 | Uzoh | |
| 6,074,286 | A | 6/2000 | Ball | |
| 6,080,050 | A | 6/2000 | Chen et al. | |
| 6,083,085 | A | 7/2000 | Lankford | |
| 6,106,351 | A | 8/2000 | Raina et al. | |
| 6,108,092 | A | 8/2000 | Sandhu | |
| 6,110,820 | A | 8/2000 | Sandhu et al. | |
| 6,116,988 | A | 9/2000 | Ball | |
| 6,120,354 | A | 9/2000 | Koos et al. | |
| 6,135,856 | A | 10/2000 | Tjaden et al. | |
| 6,139,402 | A | 10/2000 | Moore | |
| 6,143,123 | A | 11/2000 | Robinson et al. | |
| 6,143,155 | A | 11/2000 | Adams et al. | |
| 6,152,803 | A | 11/2000 | Boucher et al. | |
| 6,152,808 | A | 11/2000 | Moore | |
| 6,171,174 | B1 * | 1/2001 | Campbell et al. | 451/5 |
| 6,176,992 | B1 | 1/2001 | Talieh | |
| 6,180,525 | B1 | 1/2001 | Morgan | |
| 6,184,571 | B1 | 2/2001 | Moore | |
| 6,187,681 | B1 | 2/2001 | Moore | |
| 6,190,494 | B1 | 2/2001 | Dow | |
| 6,191,037 | B1 | 2/2001 | Robinson et al. | |
| 6,191,864 | B1 | 2/2001 | Sandhu | |
| 6,193,588 | B1 | 2/2001 | Carlson et al. | |
| 6,200,901 | B1 | 3/2001 | Hudson et al. | |
| 6,203,404 | B1 | 3/2001 | Joslyn et al. | |
| 6,203,407 | B1 | 3/2001 | Robinson | |
| 6,203,413 | B1 | 3/2001 | Skrovan | |
| 6,206,754 | B1 | 3/2001 | Moore | |
| 6,206,756 | B1 | 3/2001 | Chopra et al. | |
| 6,206,769 | B1 | 3/2001 | Walker | |
| 6,208,425 | B1 | 3/2001 | Sandhu et al. | |
| 6,210,257 | B1 | 4/2001 | Carlson | |
| 6,213,845 | B1 | 4/2001 | Elledge | |
| 6,218,316 | B1 | 4/2001 | Marsh | |
| 6,224,466 | B1 | 5/2001 | Walker et al. | |
| 6,227,955 | B1 | 5/2001 | Custer et al. | |
| 6,234,874 | B1 | 5/2001 | Ball | |
| 6,234,877 | B1 | 5/2001 | Koos et al. | |
| 6,234,878 | B1 | 5/2001 | Moore | |
| 6,237,483 | B1 | 5/2001 | Blalock | |
| 6,241,593 | B1 | 6/2001 | Chen et al. | |
| 6,250,994 | B1 | 6/2001 | Chopra et al. | |
| 6,251,785 | B1 | 6/2001 | Wright | |
| 6,261,151 | B1 | 7/2001 | Sandhu et al. | |
| 6,261,163 | B1 | 7/2001 | Walker et al. | |
| 6,267,650 | B1 | 7/2001 | Hembree | |
| 6,273,786 | B1 | 8/2001 | Chopra et al. | |
| 6,273,796 | B1 | 8/2001 | Moore | |
| 6,276,996 | B1 | 8/2001 | Chopra | |
| 6,277,009 | B1 | 8/2001 | Chen et al. | |
| 6,287,879 | B1 | 9/2001 | Gonzales et al. | |
| 6,290,572 | B1 | 9/2001 | Hofmann | |
| 6,301,006 | B1 | 10/2001 | Doan | |
| 6,303,507 | B1 * | 10/2001 | Wang et al. | 438/692 |
| 6,306,012 | B1 | 10/2001 | Sabde | |
| 6,306,014 | B1 | 10/2001 | Walker et al. | |
| 6,306,768 | B1 | 10/2001 | Klein | |
| 6,312,558 | B1 | 11/2001 | Moore | |
| 6,313,038 | B1 | 11/2001 | Chopra et al. | |
| 6,319,420 | B1 | 11/2001 | Dow | |
| 6,323,046 | B1 | 11/2001 | Agarwal | |
| 6,325,696 | B1 | 12/2001 | Boggs et al. | |
| 6,328,632 | B1 | 12/2001 | Chopra | |
| 6,331,488 | B1 | 12/2001 | Doan et al. | |
| 6,338,667 | B1 | 1/2002 | Sandhu et al. | |
| 6,350,180 | B1 | 2/2002 | Southwick | |
| 6,350,691 | B1 | 2/2002 | Lankford | |
| 6,352,466 | B1 | 3/2002 | Moore | |
| 6,354,923 | B1 | 3/2002 | Lankford | |
| 6,354,930 | B1 | 3/2002 | Moore | |
| 6,358,122 | B1 | 3/2002 | Sabde et al. | |
| 6,358,127 | B1 | 3/2002 | Carlson et al. | |
| 6,358,129 | B1 * | 3/2002 | Dow | 451/285 |
| 6,361,417 | B1 | 3/2002 | Walker et al. | |
| 6,362,105 | B1 | 3/2002 | Moore | |
| 6,364,746 | B1 | 4/2002 | Moore | |
| 6,364,757 | B1 | 4/2002 | Moore | |
| 6,368,190 | B1 | 4/2002 | Easter et al. | |
| 6,368,193 | B1 | 4/2002 | Carlson et al. | |
| 6,368,194 | B1 | 4/2002 | Sharples et al. | |
| 6,368,197 | B1 | 4/2002 | Elledge | |

| | | | | |
|---|---|---|---|---|
| 6,376,381 | B1 | 4/2002 | Sabde | |
| 6,387,289 | B1 | 5/2002 | Wright | |
| 6,402,884 | B1 | 6/2002 | Robinson et al. | |
| 6,447,369 | B1 | 9/2002 | Moore | |
| 6,458,015 | B1 | 10/2002 | Robinson et al. | |
| 6,537,133 | B1 | 3/2003 | Birang et al. | |
| 6,579,799 | B1 | 6/2003 | Chopra et al. | |
| 6,609,947 | B1 | 8/2003 | Moore | |
| 6,769,970 | B1 * | 8/2004 | Taylor et al. | 451/59 |
| 6,799,136 | B1 * | 9/2004 | Patel et al. | 702/127 |
| 2002/0049029 | A1 * | 4/2002 | Large et al. | 451/288 |
| 2002/0102917 | A1 * | 8/2002 | Lee et al. | 451/21 |
| 2002/0164924 | A1 * | 11/2002 | Korovin | 451/5 |
| 2002/0197745 | A1 * | 12/2002 | Shanmugasundram et al. | 438/5 |
| 2003/0027424 | A1 * | 2/2003 | Paik | 438/692 |
| 2003/0199112 | A1 * | 10/2003 | Shanmugasundram et al. | 438/17 |
| 2005/0032459 | A1 * | 2/2005 | Surana et al. | 451/5 |

OTHER PUBLICATIONS

Applied Materials, "Mirra Mesa Advanced Integrated CMP", 2 pages □□http://www.appliedmaterials.com/products/mirra_mesa.html.*

PCB Piezotronics, "General Piezoelectric Theory," 5 pages, 1999, retrieved from the Internet on Jun. 14, 2002, <http://www.pcb.com/techsupport/tech_gen.aspx>.

PCB Piezotronics, "Introduction to Piezoelectric Pressure Sensors," 15 pages, 1999, retrieved from the Internet on Jun. 14, 2002, <http://www.pcb.com/techsupport/tech_pres.aspx>.

PCB Piezotronics, "Introduction to Piezoelectric Force Sensors," 14 pages, 1999, retrieved from the Internet on Jun. 14, 2002, <http://www.pcb.com/techsupport/tech_force.aspx>.

Piezomechanik—Dr. Lutz Pickelmann GmbH, "Piezoelectric bending actuators, Disk translators, Piezoelectric tubes," 12 pages, Nov. 1998, Munich, <http://www.piezomechanik.com>.

Semiseek News, "Nova Measuring Instruments Introduces the Fastest Integrated Metrology Tool on the Market—the NovaScan 2040," 2 pages, Jul. 19, 2002, <http://www.semiseeknews.com/pres_release4069.htm>.

Applied Materials, "Mirra Mesa Advanced Integrated CMP," 2 pages, retrieved from the Internet on Oct. 5, 2003, <http://www.appliedmaterials.com/products/mirra_mesa.html>.

Kondo, S. et al., "Abrasive-Free Polishing for Copper Damascene Interconnection," Journal of the Electrochemical Society, vol. 147, No. 10, pp. 3907-3913, The Electrochemical Society, Inc., Pennington, New Jersey, 2000.

* cited by examiner

SYSTEMS AND METHODS FOR MECHANICAL AND/OR CHEMICAL-MECHANICAL POLISHING OF MICROFEATURE WORKPIECES

TECHNICAL FIELD

The present invention relates to systems and methods for polishing microfeature workpieces. In particular, the present invention relates to mechanical and/or chemical-mechanical polishing of microfeature workpieces with workpiece carrier assemblies that include piezoelectric members.

BACKGROUND

Mechanical and chemical-mechanical planarization processes (collectively, "CMP") remove material from the surface of microfeature workpieces in the production of microelectronic devices and other products. FIG. 1 schematically illustrates a rotary CMP machine 10 with a platen 20, a carrier head 30, and a planarizing pad 40. The CMP machine 10 may also have an under-pad 25 between an upper surface 22 of the platen 20 and a lower surface of the planarizing pad 40. A drive assembly 26 rotates the platen 20 (indicated by arrow F) and/or reciprocates the platen 20 back and forth (indicated by arrow G). Since the planarizing pad 40 is attached to the under-pad 25, the planarizing pad 40 moves with the platen 20 during planarization.

The carrier head 30 has a lower surface 32 to which a microfeature workpiece 12 may be attached, or the workpiece 12 may be attached to a resilient pad 34 under the lower surface 32. The carrier head 30 may be a weighted, free-floating wafer carrier, or an actuator assembly 36 may be attached to the carrier head 30 to impart rotational motion to the microfeature workpiece 12 (indicated by arrow J) and/or reciprocate the workpiece 12 back and forth (indicated by arrow I).

The planarizing pad 40 and a planarizing solution 44 define a planarizing medium that mechanically and/or chemically-mechanically removes material from the surface of the microfeature workpiece 12. The planarizing solution 44 may be a conventional CMP slurry with abrasive particles and chemicals that etch and/or oxidize the surface of the microfeature workpiece 12, or the planarizing solution 44 may be a "clean" nonabrasive planarizing solution without abrasive particles. In most CMP applications, abrasive slurries with abrasive particles are used on nonabrasive polishing pads, and clean nonabrasive solutions without abrasive particles are used on fixed-abrasive polishing pads.

To planarize the microfeature workpiece 12 with the CMP machine 10, the carrier head 30 presses the workpiece 12 facedown against the planarizing pad 40. More specifically, the carrier head 30 generally presses the microfeature workpiece 12 against the planarizing solution 44 on a planarizing surface 42 of the planarizing pad 40, and the platen 20 and/or the carrier head 30 moves to rub the workpiece 12 against the planarizing surface 42. As the microfeature workpiece 12 rubs against the planarizing surface 42, the planarizing medium removes material from the face of the workpiece 12.

The CMP process must consistently and accurately produce a uniformly planar surface on the workpiece to enable precise fabrication of circuits and photo-patterns. A nonuniform surface can result, for example, when material from one area of the workpiece is removed more quickly than material from another area during CMP processing. To compensate for the nonuniform removal of material, carrier heads have been developed with expandable interior and exterior bladders that exert downward forces on selected areas of the workpiece. These carrier heads, however, have several drawbacks. For example, the typical bladder has a curved edge that makes it difficult to exert a uniform downward force at the perimeter. Moreover, conventional bladders cover a fairly broad area of the workpiece, thus limiting the ability to localize the downward force on the workpiece. Furthermore, conventional bladders are often filled with compressible air that inhibits precise control of the downward force. In addition, carrier heads with multiple bladders form a complex system that is subject to significant downtime for repair and/or maintenance, causing a concomitant reduction in throughput.

DETAILED DESCRIPTION

A. Overview

Figure 1:
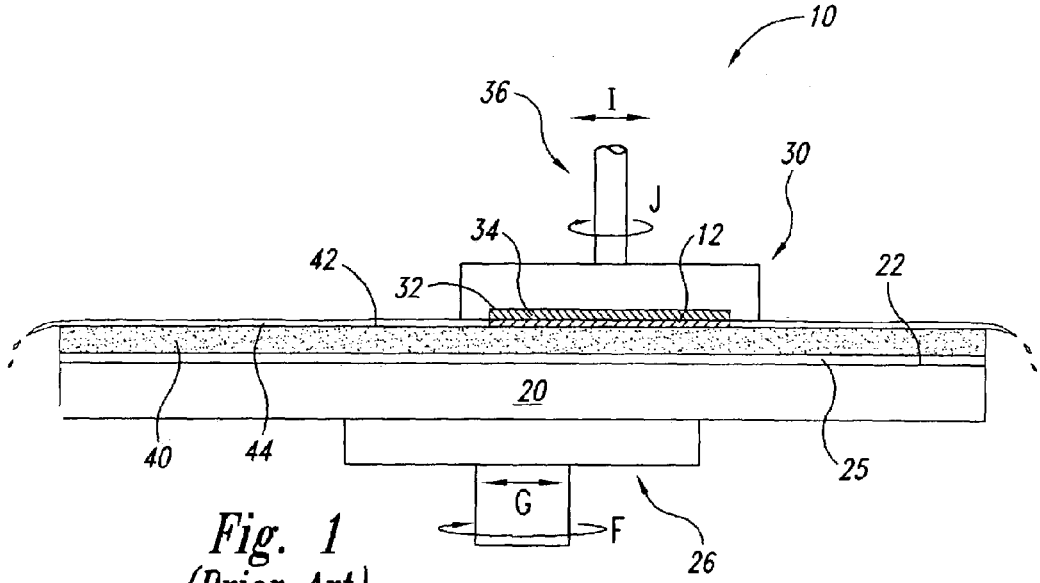
Fig. 1 (Prior Art)
FIG. 1 is a schematic cross-sectional side view of a portion of a rotary planarizing machine in accordance with the prior art.

The present invention is directed to methods and systems for mechanical and/or chemical-mechanical polishing of microfeature workpieces. The term "microfeature workpiece" is used throughout to include substrates in or on which microelectronic devices, micro-mechanical devices, data storage elements, and other features are fabricated. For example, microfeature workpieces can be semiconductor wafers, glass substrates, insulated substrates, or many other types of substrates. Furthermore, the terms "planarization" and "planarizing" mean either forming a planar surface and/or forming a smooth surface (e.g., "polishing"). Several specific details of the invention are set forth in the following description and in FIGS. 2–4B to provide a thorough understanding of certain embodiments of the invention. One skilled in the art, however, will understand that the present invention may have additional embodiments, or that other embodiments of the invention may be practiced without several of the specific features explained in the following description.

One aspect of the invention is directed to a method for polishing a microfeature workpiece having a characteristic. In one embodiment, the method includes determining a status of the characteristic of the microfeature workpiece separate from the polishing cycle and moving a carrier head and/or a polishing pad relative to the other to rub the microfeature workpiece against the polishing pad after determining the status of the characteristic of the microfeature workpiece. The carrier head also carries a plurality of piezoelectric members. The method further includes applying pressure against a back side of the microfeature workpiece in response to the determined status of the characteristic by energizing at least one of the piezoelectric members. Determining the status of the characteristic can include determining a surface contour or a thickness of a layer of the microfeature workpiece, and the status of the characteristic can be determined with a metrology tool. The piezoelectric members can be arranged in a grid, concentrically, or in another pattern in the carrier head.

In another aspect of this embodiment, the status is a first status and the workpiece is a first workpiece. In this aspect, the method further includes determining a second status of the characteristic of the first microfeature workpiece after applying pressure against the first microfeature workpiece and determining a first status of the characteristic of a second microfeature workpiece. The second microfeature workpiece is different than the first microfeature workpiece. The method further includes moving the carrier head and/or the polishing pad relative to the other to rub the second microfeature workpiece against the polishing pad after determining the first status of the characteristic of the second microfeature workpiece. As the workpiece rubs against the pad, pressure is applied against a back side of the second microfeature workpiece by energizing at least one of the piezoelectric members in response to the determined first status of the characteristic of the second microfeature workpiece and the difference between a desired status and the determined second status of the characteristic of the first microfeature workpiece.

Another aspect of the invention is directed to a system for polishing a microfeature workpiece having a characteristic. In one embodiment, the system includes a workpiece carrier assembly configured to carry the microfeature workpiece, a plurality of piezoelectric members carried by the workpiece carrier assembly, a polishing pad positionable under the workpiece carrier assembly for polishing the microfeature workpiece, a tool for determining a status of the characteristic of the microfeature workpiece, and a controller operably coupled to the workpiece carrier assembly, the piezoelectric members, the polishing pad, and the tool. The controller can have a computer-readable medium containing instructions to perform one of the above-mentioned methods.

B. Polishing Systems

Figure 2:
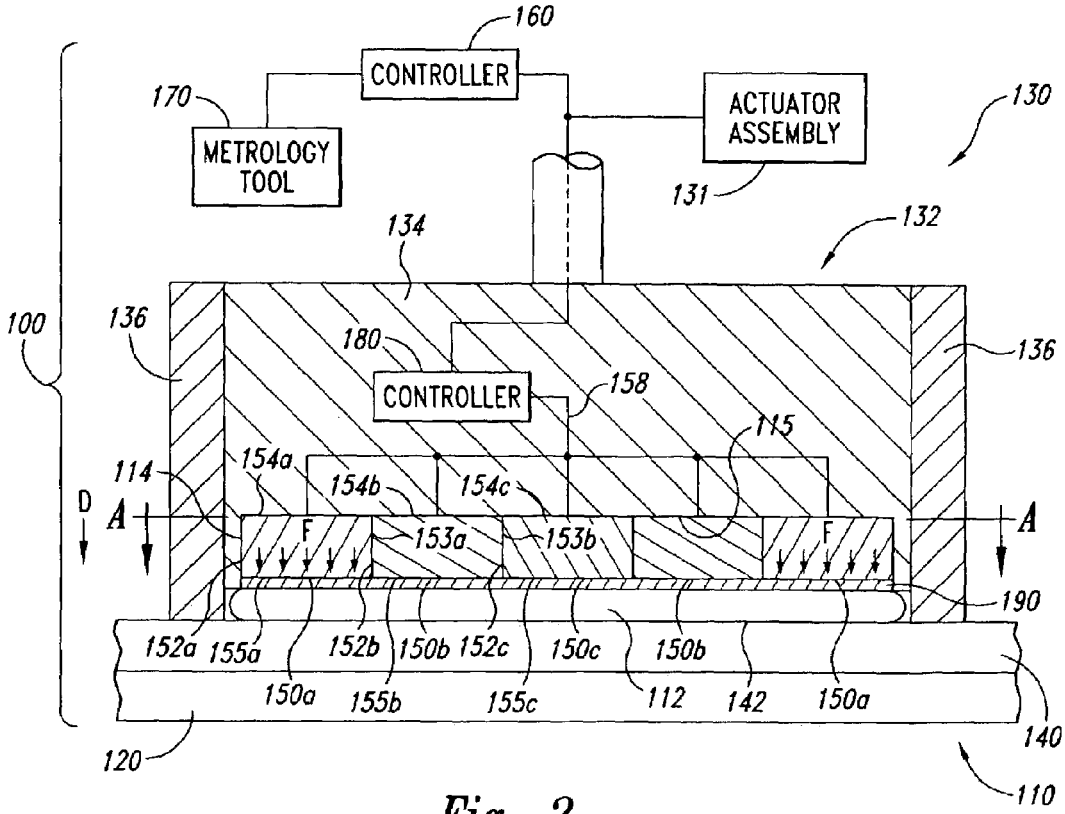
FIG. 2 is a schematic cross-sectional view of a system for polishing a microfeature workpiece in accordance with one embodiment of the invention.

FIG. 2 is a schematic cross-sectional view of a system 100 for polishing a microfeature workpiece 112 in accordance with one embodiment of the invention. The system 100 includes a CMP machine 110 (a portion of which is shown), a controller 160 (shown schematically) operably coupled to the CMP machine 110, and a metrology tool 170 (shown schematically) operably coupled to the controller 160. In the system 100, the metrology tool 170 determines the thickness of film(s) on the workpiece 112 or another characteristic of the workpiece 112. The metrology tool 170 transmits the data to the controller 160, which uses the data to control the CMP machine 110 during polishing of the workpiece 112.

In the embodiment shown in FIG. 2, the CMP machine 110 includes a platen 120, a workpiece carrier assembly 130 over the platen 120, and a planarizing pad 140 coupled to the platen 120. The workpiece carrier assembly 130 can be coupled to an actuator assembly 131 (shown schematically) to move the workpiece 112 across a planarizing surface 142 of the planarizing pad 140. In the illustrated embodiment, the workpiece carrier assembly 130 includes a head 132 having a support member 134 and a retaining ring 136 coupled to the support member 134. The support member 134 can be an annular housing having an upper plate coupled to the actuator assembly 131. The retaining ring 136 extends around the support member 134 and projects toward the workpiece 112 below a bottom rim of the support member 134.

Figure 3:
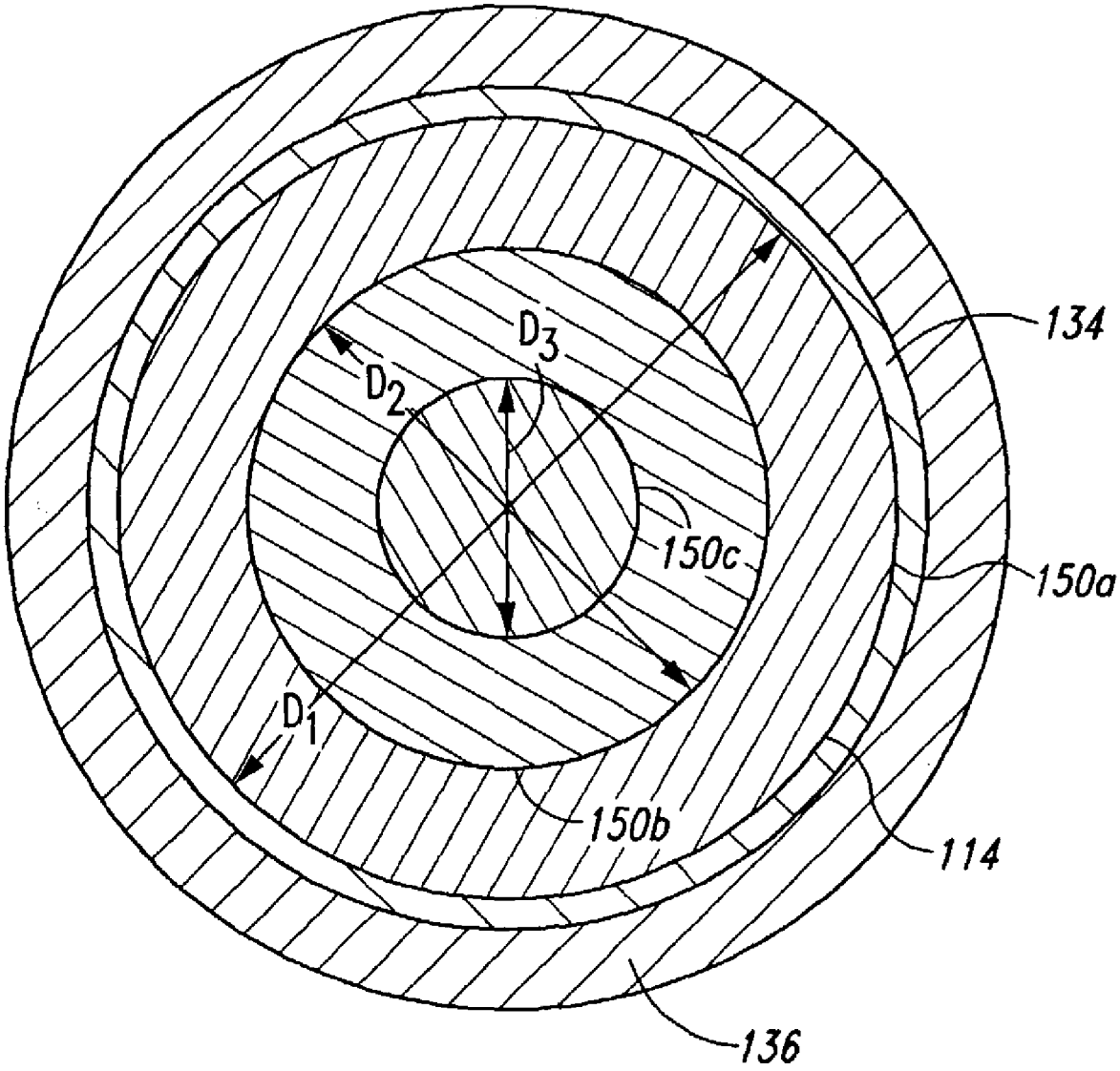
FIG. 3 is a schematic cross-sectional view taken substantially along line A—A of FIG. 2.

In one aspect of this embodiment, the workpiece carrier assembly 130 includes a chamber 114 in the head 132 and a plurality of piezoelectric members 150 (identified individually as 150*a–c*) in the chamber 114. FIG. 3 is a schematic cross-sectional view taken substantially along line A—A of FIG. 2. Referring to FIGS. 2 and 3, in the illustrated embodiment, the piezoelectric members 150 are arranged concentrically within the chamber 114. For example, a first piezoelectric member 150*a* has an outer diameter $D_1$ (FIG. 3) at least approximately equal to the inner diameter of the chamber 114, a second piezoelectric member 150*b* has an outer diameter $D_2$ (FIG. 3) at least approximately equal to the inner diameter of the first piezoelectric member 150*a*, and a third piezoelectric member 150*c* has an outer diameter $D_3$ (FIG. 3) at least approximately equal to the inner diameter of the second piezoelectric member 150*b*. In other embodiments, the piezoelectric members 150 can be spaced apart from each other. For example, the outer diameter $D_2$ of the second piezoelectric member 150*b* can be less than the inner diameter of the first piezoelectric member 150*a*. In additional embodiments, such as those described below with reference to FIGS. 4A and 4B, the piezoelectric members may have different shapes and/or configurations.

Referring to FIG. 2, in the illustrated embodiment, the piezoelectric members 150 have an outer wall 152 (identified individually as 152*a–c*), an inner wall 153 (identified individually as 153*a–b*) opposite the outer wall 152, an upper wall 154 (identified individually as 154*a–c*), and a lower wall 155 (identified individually as 155*a–c*) opposite the upper wall 154. The head 132 has a surface 115 that abuts the upper wall 154 of the piezoelectric members 150. Accordingly, when the piezoelectric members 150 are energized, the members 150 expand downwardly away from the surface 115 in the direction D. The expansion of the piezoelectric members 150 exerts a force against the workpiece 112. For example, in FIG. 2, the first piezoelectric member 150*a* is energized and exerts a force F against a perimeter region of the workpiece 112. In additional embodiments, the piezoelectric members 150 can be energized together or individually.

The workpiece carrier assembly 130 further includes a controller 180 operably coupled to the piezoelectric members 150 to selectively energize one or more of the piezoelectric members 150. More specifically, the controller 180 can provide a voltage to the piezoelectric members 150 through an electrical coupler 158. The electrical coupler 158 can include small wires that are attached to the piezoelectric members 150. The controller 180 accordingly controls the position and magnitude of the force F by selecting the piezoelectric member(s) 150 to energize and varying the voltage. In one embodiment, the controller 180 can include an IC controller chip and a telematics controller to receive wireless signals from the controller 160. In other embodiments, the controllers 160 and 180 can communicate through wired, infrared, radio frequency, or other methods. In additional embodiments, the controller 160 can operate the piezoelectric members 150 directly without interfacing with the controller 180.

The workpiece carrier assembly 130 can further include a flexible member 190 that encloses the chamber 114 and separates the lower wall 154 of the piezoelectric members 150 from the workpiece 112. The flexible member 190 can be silicone or any other suitable material that protects the piezoelectric members 150 during polishing and prevents the planarizing solution 42 (FIG. 1) from entering the chamber 114. In other embodiments, the head 132 can include additional membranes between the piezoelectric members 150 and the workpiece 112.

The metrology tool 170 measures the status of a characteristic of the workpiece 112 before polishing so the data can be used to provide a planar surface on the workpiece 112 during polishing. For example, the metrology tool 170 can measure the thickness of a layer of the workpiece 112 at several sites. After determining the status of the characteristic of the workpiece 112, the metrology tool 170 provides the data to the controller 160. The controller 160 can be an automated process controller that uses the data in controlling the polishing cycle. More specifically, the controller 160 can use the data to determine the position and strength of the forces required to provide a generally planar surface on the workpiece 112. For example, if the metrology tool 170 determines that a layer at a perimeter region of the workpiece 112 has a greater thickness than at a center region of the workpiece 112, the controller 180 can energize the first piezoelectric member 150*a* to exert the force F against the perimeter region of the workpiece 112 during polishing. The metrology tool 170 can determine the status of the characteristic before and/or after the workpiece 112 is attached to the workpiece carrier assembly 130. Suitable devices include metrology tools manufactured by Nova Measuring Instruments Ltd. of Israel and other similar devices. In additional embodiments, tools other than metrology tools can be used to determine the status of a characteristic.

In one aspect of this embodiment, the metrology tool 170 also determines the status of the characteristic of the workpiece 112 after polishing. Measuring the status of the characteristic after polishing allows the controller 160 to determine if the post-polishing status of the characteristic is the desired status. For example, the controller 160 can determine if the surface of the workpiece 112 is sufficiently planar and/or if a layer of the workpiece 112 has a desired thickness. Moreover, measuring the status of the characteristic after polishing allows the controller 160 to track the wear of the retaining ring 136, the planarizing pad 140, a conditioning stone (not shown), and/or other components of the CMP machine 110. For example, the controller 160 can track the wear of the CMP machine 110 by determining the difference between a projected status of the characteristic and the determined status of the characteristic of a workpiece at the end of the polishing cycle. The wear of the CMP machine 110 affects the polishing of the workpiece and consequently there can be a difference between the projected and determined statuses of the characteristic of the workpiece at the end of the polishing cycle. Accordingly, tracking the difference between the projected and determined statuses over a series of workpieces allows the controller 160 to determine wear in the CMP machine 110.

The controller 160 can adjust the polishing parameters, including the applied forces, when polishing subsequent workpieces, based on the difference between the projected status and the determined status of the characteristic of the previous workpiece to compensate for wear in the CMP machine 110 or other factors. For example, if after polishing the thickness of a layer of a workpiece is greater than the projected thickness, the controller 160 can adjust the applied forces, the dwell time, or other polishing parameters to increase the material removed from subsequent workpieces. In additional embodiments, the system 100 may not include a metrology tool 170 and the controller 160 can adjust the polishing parameters, including the applied forces, based upon an expected status of the characteristic of the workpiece 112. In other embodiments, the system 100 can include a sensor to monitor the planarity of the workpiece surface during polishing. In such embodiments, the controller 160 can adjust the polishing parameters, including the applied forces, based upon the monitored planarity of the workpiece.

C. Other Configurations of Piezoelectric Members

Figure 4A:
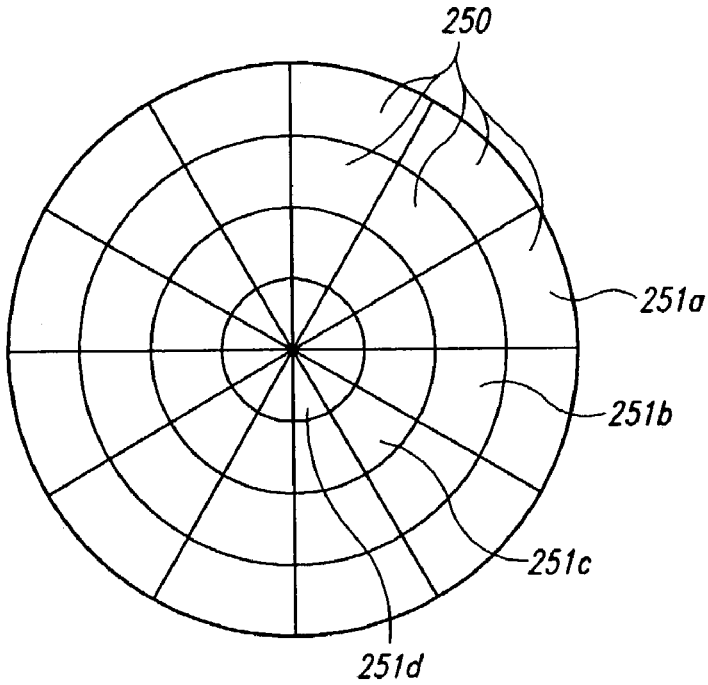
FIG. 4A is a schematic top planform view of a plurality of piezoelectric members arranged concentrically in accordance with an additional embodiment of the invention.
Figure 4B:
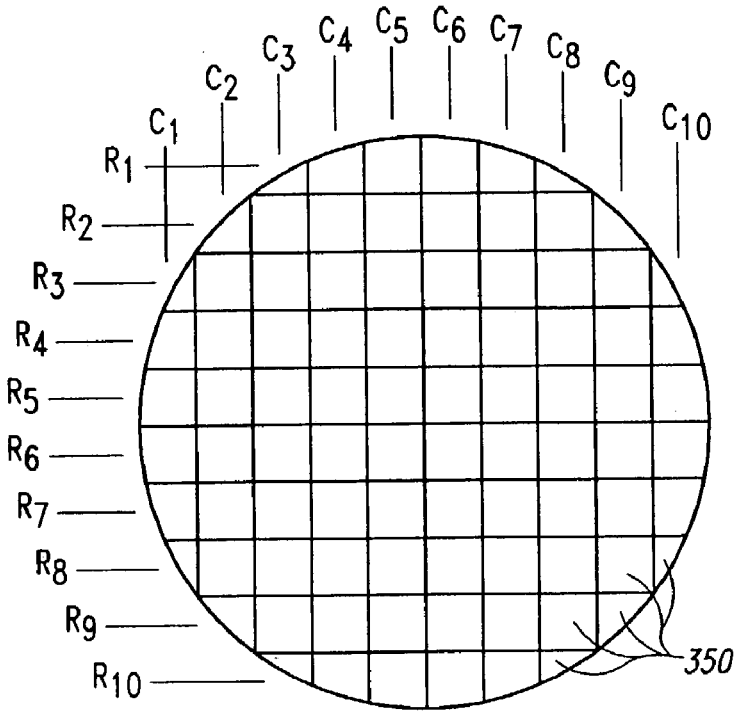
FIG. 4B is a schematic top planform view of a plurality of piezoelectric members arranged in a grid in accordance with an additional embodiment of the invention.

FIGS. 4A and 4B are schematic top planform views of several configurations of piezoelectric members for use with workpiece carrier assemblies in accordance with additional embodiments of the invention. For example, FIG. 4A illustrates a plurality of arcuate piezoelectric members 250 arranged generally concentrically in a plurality of rings 251 (identified individually as 251*a–d*). Each ring 251 is divided into generally equally sized piezoelectric members 250. In other embodiments, the piezoelectric members 250 can be arranged differently. For example, each piezoelectric member can be spaced apart from the other piezoelectric members.

FIG. 4B is a schematic top planform view of a plurality of piezoelectric members 350 in accordance with another embodiment of the invention. The piezoelectric members 350 are arranged in a grid with a plurality of rows $R_1$–$R_{10}$ and a plurality of columns $C_1$–$C_{10}$. In the illustrated embodiment, the piezoelectric members 350 proximate to the perimeter have a curved side corresponding to the curvature of the chamber 114 (FIG. 2) in the workpiece carrier assembly 130 (FIG. 2). In additional embodiments, the size of each piezoelectric member can decrease to increase the resolution. In other embodiments, the piezoelectric members can be arranged in other configurations, such as in quadrants or in a single circle.

One advantage of the polishing systems of the illustrated embodiments is the ability to apply highly localized forces to a workpiece in response to a predetermined characteristic of the workpiece. This highly localized force control enables the CMP process to consistently and accurately produce a uniformly planar surface on the workpiece. Moreover, the system can also adjust the applied forces and polishing parameters to account for wear of the CMP machine. Another advantage of the illustrated workpiece carrier assemblies is that they are simpler than existing systems and, consequently, reduce downtime for maintenance and/or repair and create greater throughput.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

I claim:

1. A method for polishing a microfeature workpiece having a characteristic, the method comprising:

determining a first status of the characteristic of the microfeature workpiece separate from the polishing cycle;

moving at least one of a carrier head and a planarizing medium relative to the other after determining the first status of the characteristic of the microfeature workpiece, the carrier head carrying a plurality of driving members;

applying pressure against a back side of the microfeature workpiece in response to the determined first status of the characteristic by controlling at least one of the plurality of driving members;

determining a second status of the characteristic of the microfeature workpiece after applying pressure against the microfeature workpiece; and tracking the difference between a desired status and the second status of the characteristic of the microfeature workpiece to determine wear in at least one of the planarizing medium, the carrier head, or a conditioning stone;

wherein applying pressure against the back side of the microfeature workpiece comprises controlling at least one of the plurality of driving members based on a predetermined wear of at least one of the carrier head, the planarizing medium, or the conditioning stone.

2. The method of claim 1 wherein determining the first status of the characteristic comprises determining a surface contour of the microfeature workpiece.

3. The method of claim 1 wherein determining the first status of the characteristic comprises determining a thickness of a layer of the microfeature workpiece.

4. The method of claim 1 wherein determining the first status of the characteristic comprises determining the status of the characteristic with a metrology tool.

5. The method of claim 1 wherein the microfeature workpiece comprises a first microfeature workpiece, and wherein the method further comprises:

determining a first status of the characteristic of a second microfeature workpiece, the second microfeature workpiece being different than the first microfeature workpiece;

moving at least one of the carrier head and the planarizing medium relative to the other after determining the first status of the characteristic of the second microfeature workpiece; and applying pressure against a back side of the second microfeature workpiece by controlling at least one of the plurality of driving members in response to the determined first status of the characteristic of the second microfeature workpiece and the difference between a desired status and the determined second status of the characteristic of the first microfeature workpiece.

6. The method of claim 1 wherein applying pressure against the microfeature workpiece comprises applying pressure against the workpiece to provide a desired status of the characteristic of the workpiece.

7. The method of claim 1 wherein:

determining the first status of the characteristic comprises determining the status of the characteristic in a first region; and applying pressure against the microfeature workpiece comprises applying pressure against the back side of the microfeature workpiece in the first region.

8. The method of claim 1 wherein the plurality of driving members are arranged concentrically, and wherein applying pressure against the microfeature workpiece comprises controlling at least one of the concentrically arranged driving members.

9. The method of claim 1 wherein the plurality of driving members are arranged in a grid, and wherein applying pressure against the microfeature workpiece comprises controlling at least one of the driving members arranged in the grid.

10. The method of claim 1 wherein:

determining the first status of the characteristic comprises determining a thick area and a thin area on the microfeature workpiece; and applying pressure against the back side comprises applying a first pressure at the thick area of the microfeature workpiece and a second pressure at the thin area of the microfeature workpiece, wherein the second pressure is different than the first pressure.

11. The method of claim 1 wherein applying pressure against the back side comprises:

arranging the at least one driving member in a first position to exert a first pressure against the back side of the microfeature workpiece; and moving the at least one driving member from the first position to a second position to exert a second pressure against the back side of the microfeature workpiece.

12. The method of claim 1 wherein the driving members comprise a plurality of piezoelectric members, and wherein controlling at least one of the driving members comprises energizing at least one of the piezoelectric members.

13. A method of polishing a microfeature workpiece having a region with a predetermined status of a characteristic, the method comprising:

moving at least one of a carrier head and a planarizing medium relative to the other, the carrier head carrying a plurality of piezoelectric members; and providing a desired status of the characteristic in the region of the microfeature workpiece by energizing at least one of the plurality of piezoelectric members based on the predetermined status of the characteristic to exert a force against a back side of the microfeature workpiece, wherein the predetermined status of the characteristic is obtained separate from the polishing cycle;

wherein providing the desired status of the characteristic comprises energizing at least one of the plurality of piezoelectric members based on a predetermined wear of at least one of the carrier head, the planarizing medium, or a conditioning stone.

14. The method of claim 13 wherein the region comprises a first region, wherein the at least one of the plurality of piezoelectric members comprises a first piezoelectric member, and wherein the method further comprises:

determining a status of the characteristic of a second region of the microfeature workpiece, the second region being different than the first region; and providing a desired status of the characteristic in the second region of the microfeature workpiece by energizing a second piezoelectric member based on the determined status of the characteristic of the second region, the second piezoelectric member being different than the first piezoelectric member.

15. The method of claim 13 wherein the plurality of piezoelectric members are arranged concentrically, and wherein providing the desired status of the characteristic comprises energizing at least one of the concentrically arranged piezoelectric members.

16. The method of claim 13 wherein the plurality of piezoelectric members are arranged in a grid, and wherein providing the desired status of the characteristic comprises energizing at least one of the piezoelectric members arranged in the grid.

17. The method of claim 13 wherein providing the desired status of the characteristic comprises:

arranging the at least one piezoelectric member in a first position to exert a first force against the back side of the microfeature workpiece; and moving the at least one piezoelectric member from the first position to a second position to exert a second force against the back side of the microfeature workpiece.

18. A method for polishing a plurality of microfeature workpieces, comprising:

determining a first status of a characteristic of a first microfeature workpiece separate from the polishing cycle;

moving at least one of a carrier head and a planarizing medium relative to the other, the carrier head having a plurality of driving members;

controlling at least one of the plurality of driving members to apply pressure against a back side of the first microfeature workpiece in response to the determined first status of the characteristic of the first microfeature workpiece;

determining a second status of the characteristic of the first microfeature workpiece after controlling at least one of the plurality of driving members;

determining a first status of a characteristic of a second microfeature workpiece separate from the polishing cycle, the second microfeature workpiece being different than the first microfeature workpiece;

moving at least one of the carrier head and the planarizing medium relative to the other;

controlling at least one of the plurality of driving members to apply pressure against a back side of the second microfeature workpiece in response to the determined first status of the characteristic of the second microfeature workpiece and the difference between a desired status and the determined second status of the characteristic of the first microfeature workpiece; and tracking the difference between a desired status and the determined second status of the characteristic of the first microfeature workpiece to determine wear in at least one of the planarizing medium, the carrier head, or a conditioning stone;

wherein controlling at least one of the plurality of driving members to apply pressure against the back side of the second microfeature workpiece comprises operating at least one of the plurality of driving members based on a predetermined wear of at least one of the carrier head, the planarizing medium, or the conditioning stone.

19. The method of claim 18 wherein determining the first and second statuses of the characteristic of the first microfeature workpiece comprise determining a surface contour of the first microfeature workpiece.

20. The method of claim 18 wherein determining the first and second statuses of the characteristic of the first microfeature workpiece comprise determining a thickness of a layer of the first microfeature workpiece.

21. The method of claim 18 wherein determining the first and second statuses of the characteristic of the first microfeature workpiece comprise determining the first and second statuses of the characteristic with a metrology tool.

22. The method of claim 18 wherein the plurality of driving members are arranged concentrically, and wherein controlling at least one of the plurality of driving members to apply pressure against the first microfeature workpiece comprises controlling at least one of the plurality of concentrically arranged driving members.

23. A method for polishing a microfeature workpiece having a characteristic, the method comprising:

determining a first status of the characteristic of the microfeature workpiece separate from the polishing cycle;

arranging a plurality of driving members in a carrier head based on the determined status of the characteristic;

monitoring the planarity of a surface of the microfeature workpiece during the polishing cycle;

rearranging at least some of the plurality of driving members based on the monitored planarity of the surface of the microfeature workpiece during the polishing cycle;

determining a second status of the characteristic of the microfeature workpiece after rearranging at least some of the driving members; and tracking the difference between a desired status and the second status of the characteristic of the microfeature workpiece to determine wear in at least one of a planarizing medium, the carrier head, or a conditioning stone;

wherein rearranging at least some of the plurality of driving members comprises positioning at least some of the plurality of driving members based on a predetermined wear of at least one of the carrier head, the planarizing medium, or the conditioning stone.

24. The method of claim 23 wherein:

the plurality of driving members comprise a first driving member;

arranging the driving members comprises arranging the first driving member in a first position to exert a first force on the workpiece; and rearranging the driving members comprises moving the first driving member to a second position to exert a second force on the workpiece, the first position being different than the second position.

25. The method of claim 23 wherein:

the plurality of driving members comprise a first driving member;

arranging the driving members comprises positioning the first driving member to exert a first pressure on the workpiece; and rearranging the driving members comprises positioning the first driving member to exert a second pressure on the workpiece, the first pressure being different than the second pressure.

* * * * *